United States Patent [19]

Stoll et al.

[11] 4,210,004

[45] Jul. 1, 1980

[54] BATCH WASHING MACHINES

[75] Inventors: Karl-Heinz A. Stoll, Dreieich; Heinz Miessler, Pattensen, both of Fed. Rep. of Germany

[73] Assignee: Vosswerke GmbH, Sarstedt, Fed. Rep. of Germany

[21] Appl. No.: 950,263

[22] Filed: Oct. 11, 1978

[30] Foreign Application Priority Data

Oct. 12, 1977 [DE] Fed. Rep. of Germany ..... 2745787

[51] Int. Cl.[2] ..... D06F 21/02; D06F 37/08

[52] U.S. Cl. ..... 68/27; 68/58; 68/143; 134/65

[58] Field of Search ..... 68/58, 143, 145, 27; 134/65, 132

[56] References Cited

U.S. PATENT DOCUMENTS

| | | | |
|---|---|---|---|
| 1,251,073 | 12/1917 | Maloney | 134/65 X |
| 2,288,742 | 7/1942 | Ransohoff | 134/65 |
| 3,103,802 | 9/1963 | Streich | 68/58 X |
| 3,336,768 | 8/1967 | Kleefisch | 68/58 |
| 3,946,580 | 3/1976 | Stoll | 68/145 |
| 4,020,659 | 5/1977 | Bhavsar | 68/58 X |
| 4,034,583 | 7/1977 | Miessler | 68/143 X |
| 4,073,301 | 2/1978 | Mackinnon | 134/65 |

FOREIGN PATENT DOCUMENTS

| | | | |
|---|---|---|---|
| 2235599 | 1/1974 | Fed. Rep. of Germany | 68/143 |

*Primary Examiner*—Robert L. Bleutge

*Attorney, Agent, or Firm*—Larson, Taylor and Hinds

[57] ABSTRACT

A batch washing machine comprises an imperforate drum open at both ends and mounted for rotation about a substantially horizontal axis. A conveyor worm having an imperforate helical surface is rigidly mounted in the interior of the drum to divide same into a plurality of individual chambers. Washing media is fed to the chambers by means of a pipe disposed on a central axis of the drum, the pipe being sub-divided into individual pipe portions by the helical surface of the conveyor worm, with each pipe portion including at least one outlet aperture communicating with a respective one of the chambers. At least one emptying aperture is provided in the drum for each chamber and through which washing media can be discharged from the chamber. During washing, each chamber is separated from the other chambers, so that the machine can wash different types of washing at the same time.

4 Claims, 6 Drawing Figures

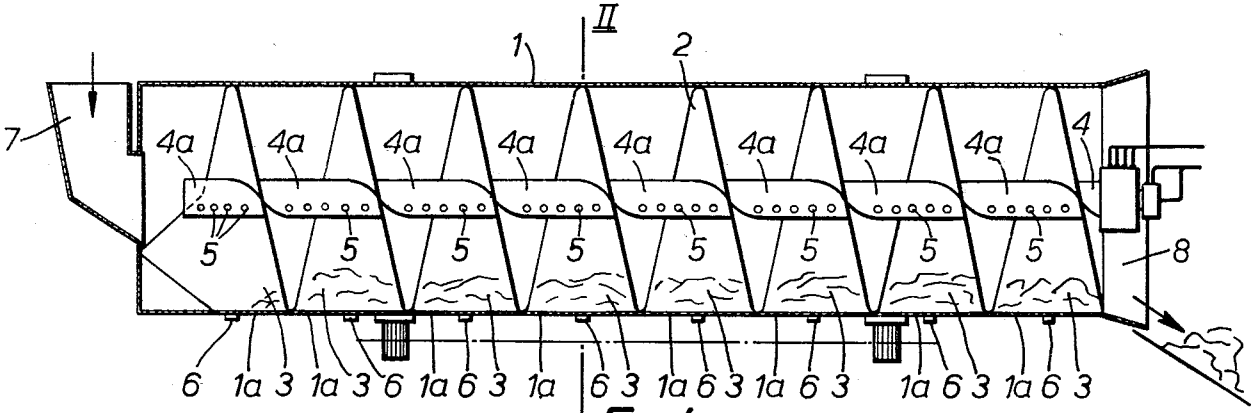
FIG. 1.
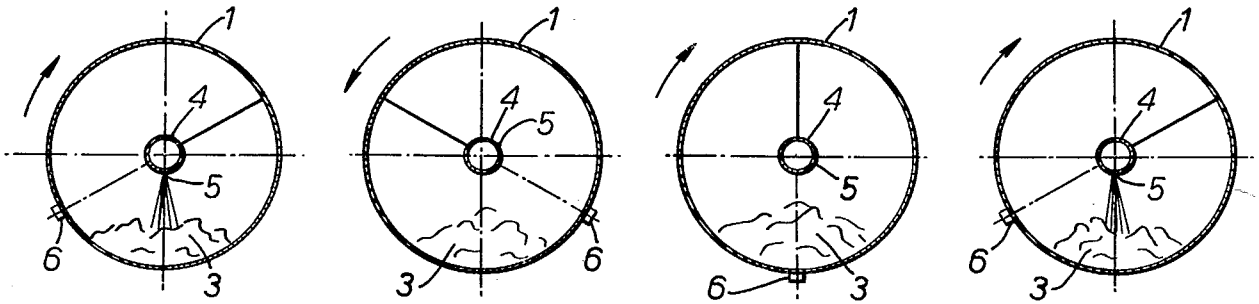
FIG. 2.
FIG. 3.
FIG. 4.
FIG. 5.

BATCH WASHING MACHINES

BACKGROUND OF THE INVENTION

1. Field of the Invention

The present invention relates to batch washing machines.

2. Description of the Prior Art

There is proposed in German Offenlegungsschrift No. 1,964,414 a batch washing machine comprising a horizontal imperforate drum which is divided into individual chambers by a conveyor worm rigidly disposed within it. In the central axis of the drum there is disposed a central pipe carrying washing water, suds, steam and the like and which is subdivided into individual central pipe portions by the helical surface of the conveyor worm, the washing process being carried out by rotating of the drum with an alternating motion, while the laundry can be transported from one chamber into the next chamber by a rotary movement of the drum through 360° in a single direction.

In the machine proposed by German Offenlegungsschrift No. 1,964,414 there are in the helical surface of the conveyor worm, apertures by which the individual chambers are connected to form treatment zones. The detergent solution required for the process is fed to one or other chamber in the treatment zone through the pipe located on the central axis of the drum. The detergent solution moves through the apertures in the helical surface in countercurrent from chamber to chamber, being discharged from the final chamber in the treatment zone (pre-washing zone, final washing zone, rinsing zone). The washing process occurs thereby by an alternating rotary movement of the drum, while transport of the laundry as such is brought about by a rotary movement of the drum in a single direction.

A disadvantage of this known washing machine which operates on the counter-current principle is the lack of detergent solution separation from chamber to chamber as a result of the apertures in the helical surface of the conveyor worm. This washing machine is thus only suitable for continuous operation involving always only one type of laundry requiring to be washed. A simultaneous washing of batches of laundry involving different types of items, for example coloureds and whites, necessitating a complete separation of the detergent solution, is impossible. In practice, however, there is an increasing need for the simultaneous treatment of different types of laundry in one and the same washing process.

SUMMARY OF THE INVENTION

According to the invention, there is provided in a batch washing machine, an imperforate drum open at both ends and mounted fo rotation about a substantially horizontal axis, a conveyor worm having an imperforate helical surface, said worm being rigidly mounted in the interior of the drum to divide same into a plurality of individual chambers, a pipe disposed on the central axis of the drum for carrying washing media, said pipe being sub-divided into individual pipe portions by the helical surface of the conveyor worm, each said pipe portion including at least one outlet aperture, and means defining at least one emptying aperture in the drum for each chamber and through which washing media can be discharged from the chamber, the arrangement being such that washing is effected by partly rotating the drum with an alternating motion, and that transfer of washing from one chamber to a subsequent chamber is effected by rotation of the drum through 360° in a single direction.

Since the helical surface of the conveyor worm is imperforate, a complete separation of the detergent solution from chamber to chamber is ensured. This separation of detergent solution is a basic prerequisite for the washing of batches of laundry of several types, e.g. coloureds and whites and the like. However, complete separation of the detergent solution also necessitates each individual chamber being subject to a separate supply of washing media and separate emptying, and these effects are provided, respectively, by each of the pipe portions having an outlet aperture, and each chamber having its own emptying aperture.

BRIEF DESCRIPTION OF THE DRAWINGS

An embodiment of the invention will now be described, by way of example only with reference to the accompanying diagrammatic drawings, in which:

FIG. 1 is a longitudinal section through a washing machine according to the invention, the drum of the machine being shown in its emptying position;

FIGS. 2 to 5 are vertical sections taken on line II—II of FIG. 1, and showing different angular positions of the drum.

DESCRIPTION OF THE PREFERRED EMBODIMENT

Figure 6:
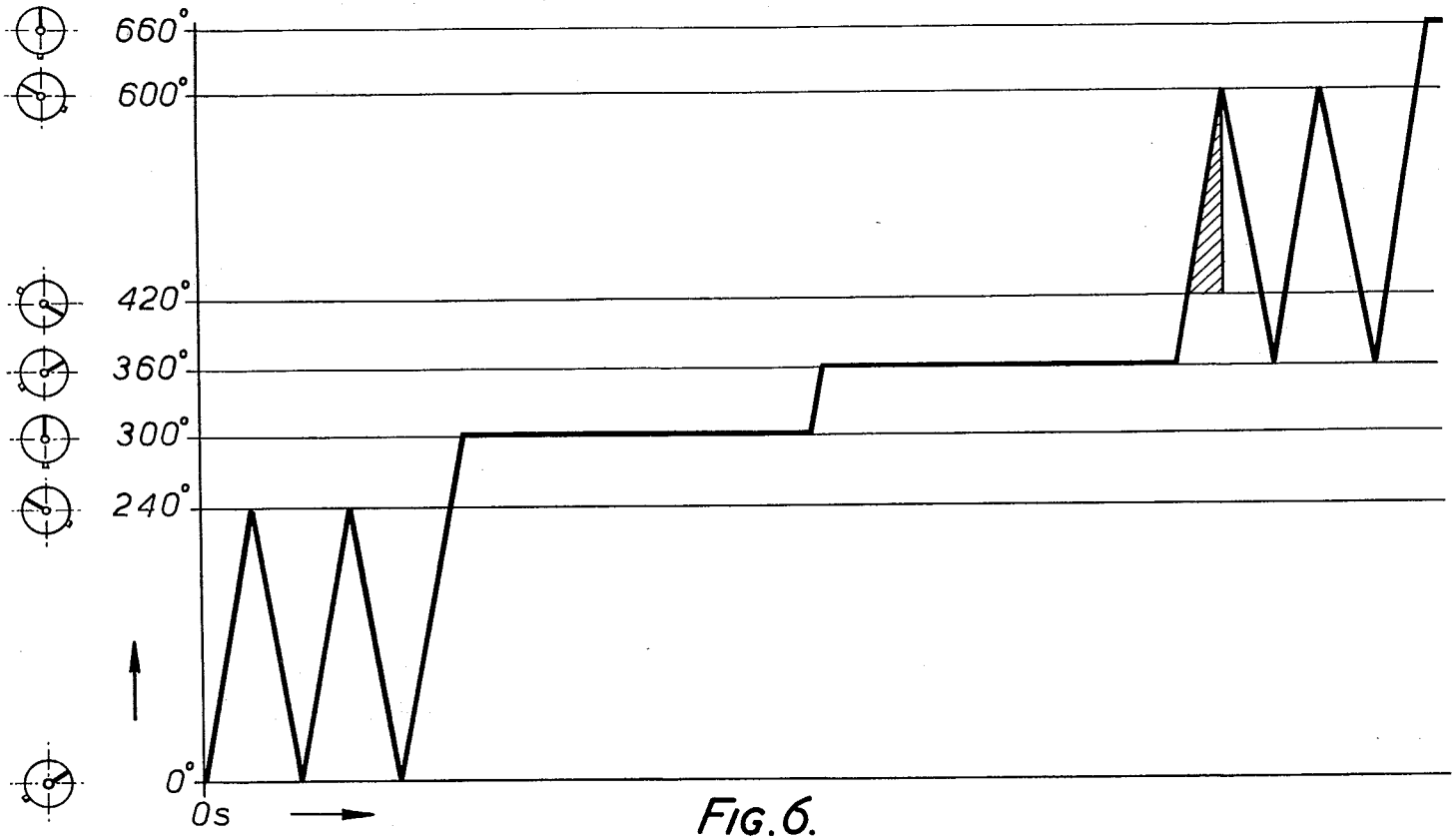
FIG. 6 is a graph of drum angle v time and showing the washing-transporting and emptying process of the drum.

In the drawings the reference numeral 1 denotes a washing drum which is open at both ends, is horizontally mounted, and is imperforate, the drum being driven for rotation in either direction by reversible drive means. The drive means is not shown in the drawing but a suitable construction for such drive means will be readily apparent to persons skilled in the art. The drum 1 is sub-divided into individual chambers 3 by a conveyor worm 2, the sub-division being effected by the helical surface of this conveyor worm 2.

Located on the central axis of the drum 1 is a central pipe 4 which can be fed with washing water, suds, steam and the like. As is shown clearly in FIG. 1 of the drawings, this central pipe 4 is divided into individual portions **4*a* by the helical surface of the worm 2. The helical surface is imperforate, so that there is no connection between the individual chambers 3** across the helical surface.

Provided in each portion **4*a* of the central pipe are outlet orifices 5 through which the washing media can be introduced into the individual chambers 3. Naturally, it is within the scope of the invention, instead of a plurality of outlet orifices 5, to provide only a single outlet orifice in each portion 4*a*** of the central pipe.

Provided in each portion **1*a* of the drum, which is associated with the corresponding chamber 3, there is at least one discharge orifice 6 through which the used detergent solution and the like is emptied. The discharge orifice 6** communicates with a ducting system which feeds the detergent solution to a regenerating device. For reasons of clarity, this ducting system is not illustrated in the drawings.

The batch washing machine according to the invention operates in the following manner.

A batch of laundry is introduced through a loading hopper 7 into the first chamber 3 of the drum 1. Then, all chambers 3 are supplied with washing media through the central pipe 4 and the outlet orifices 5. At this stage the washing drum 1 and the emptying apertures 6 thereof are located at the angular position shown in FIG. 2 which corresponds to the 0° position illustrated in FIG. 6.

Now the actual washing process commences, the washing process being effected by rotating the drum alternately backwards and forwards through an angle of about 240°. During this action the drum 1 alternately assumes the positions shown in FIGS. 2 and 3. These movements of the drum are illustrated by a sawtooth line in FIG. 6, the extreme points of which represent the 0° and 240° positions of the drum.

The final rotation of this first washing process ends with an additional rotation of the drum 1 through about 60° into the position shown in FIGS. 1 and 4. The drum 1 is then stationary for a short time. The emptying orifices 6 are thereby in the lowest position of the drum 1 so that emptying of the used detergent solution is possible. In this position, the drum 1 has turned in one direction of rotation through 240°+60°=300° (see 300° position in FIG. 6).

After emptying of the detergent solution, the drum 1 is rotated through a further 60° into the position shown in FIG. 5 of the drawings, so that the drum 1 has now completed, in one direction, a complete rotation of 240°+60°+60°=360° as can be seen from FIG. 6. By this rotary movement of the drum 1 through 360°, the laundry has been transported out of the chamber 3 shown over on the left in FIG. 1 of the drawings, into the following chamber 3.

The chambers 3 are now supplied with washing media for the second washing process and the extreme left-hand chamber 3 shown in FIG. 1 of the drawings, can now be charged with a further batch of laundry. These two operations can take place either during a brief stoppage of the washing drum 1 or even during commencement of the alternating motion (FIG. 6—line at 360° position).

The washing-emptying and transporting operations are now repeated accordingly.

In this way, the batches of laundry successively move from chamber 3 to another and are discharged batchwise at the delivery end 8 of the drum 1; this takes place during the phase of rotation of the drum 1 which is identified by the shading in FIG. 6.

The batch washing machine described may be combined with loading and removal devices for respectively supplying the machine with batches of laundry and for subsequently removing the batches discharged from the machine.

What is claimed is:

1. In a batch washing machine of the type comprising an imperforate drum open at both ends and mounted for rotation about a substantially horizontal axis, a conveyor worm having a helical surface, said worm being rigidly mounted in the interior of the drum to divide same into a plurality of individual chambers, and a pipe disposed on the central axis of the drum for carrying washing media, said pipe being sub-divided into individual pipe portions by the helical surface of the conveyor worm, each said pipe portion including at least one outlet aperture, wherein the improvement comprises means defining an imperforate worm surface and means defining at least one emptying aperture in the drum for each chamber and through which washing media can be discharged from the chamber, the washing media in each said chamber being isolated from the washing media in each other chamber, whereby mixing of washing media from one chamber with washing media in another chamber is prevented, the arrangement being such that washing is effected by partly rotating the drum with an alternating motion, and that transfer of washing from one chamber to a subsequent chamber is effected by rotation of the drum through 360°, said drum having a stop position at which the emptying apertures are located stationary at the bottom portion of the drum to permit draining of the washing media from the chambers prior to transfer of the washing from one chamber to a subsequent chamber.

2. A washing machine according to claim 1, wherein the alternating motion of the drum is effected over an angle of approximately 240°.

3. A washing machine according to claim 2, wherein the bottom position of the emptying apertures is reached after a displacement of 300° from the point at which the alternating motion of the drum begins.

4. A washing machine according to claim 3, wherein prior to the chambers being supplied with washing media, the drum is rotated on in the same direction through about 60° from the bottom position of the emptying apertures.

* * * * *